US005173310A

United States Patent [19]

Katou et al.

[11] Patent Number: 5,173,310

[45] Date of Patent: Dec. 22, 1992

[54] DEVICE FOR COOLING MOLTEN FILAMENTS IN SPINNING APPARATUS

[75] Inventors: Eiji Katou; Akifumi Katou; Yoshihiro Yoshimura, all of Kuga, Japan

[73] Assignee: Mitsui Petrochemical Industries, Ltd., Tokyo, Japan

[21] Appl. No.: 639,034

[22] Filed: Jan. 8, 1991

Related U.S. Application Data

[62] Division of Ser. No. 327,085, Mar. 22, 1989, abandoned.

[30] Foreign Application Priority Data

Mar. 24, 1988 [JP] Japan ..... 63-70915

[51] Int. Cl.[5] ..... B29C 35/06

[52] U.S. Cl. ..... 425/72.2; 264/211.13; 264/211.14; 264/211.17

[58] Field of Search ..... 425/72.2, 66, 404, 464; 264/169, 176.1, 211.13, 211.14, 211.17

[56] References Cited

U.S. PATENT DOCUMENTS

| | | | |
|---|---|---|---|
| 2,273,105 | 2/1942 | Heckert | 425/72.2 |
| 3,053,611 | 9/1962 | Griehl | 264/210.8 |
| 3,067,458 | 12/1962 | Daughert | 425/72.2 |
| 3,070,839 | 1/1963 | Thompson | 425/72.2 |
| 3,274,644 | 9/1966 | Massey et al. | 425/72.2 |
| 3,447,202 | 6/1969 | Kato | 425/72.2 |
| 3,632,719 | 1/1972 | Nozawa | 425/72.2 |
| 3,834,847 | 9/1974 | Fletcher | 425/72.2 |
| 3,999,910 | 12/1976 | Pendlebury et al. | 425/72.2 |
| 4,362,682 | 12/1982 | Berg et al. | 425/72.2 |
| 4,492,557 | 1/1985 | Ray et al. | 425/72.2 |
| 4,529,368 | 7/1985 | Makansi | 425/72.2 |
| 4,631,018 | 12/1986 | Valteris et al. | 425/72.2 |
| 4,743,186 | 5/1988 | Schippers | 425/72.2 |

FOREIGN PATENT DOCUMENTS

| | | | |
|---|---|---|---|
| 44675 | 10/1963 | Belgium . | |
| 57-37454 | 8/1982 | Japan . | |
| 61-119704 | 6/1986 | Japan . | |
| 61-119705 | 6/1986 | Japan . | |
| 61-132611 | 6/1986 | Japan . | |
| 783377 | 12/1980 | U.S.S.R. | 264/237 |

*Primary Examiner*—David A. Simmons
*Assistant Examiner*—William J. Matney, Jr.
*Attorney, Agent, or Firm*—Sherman and Shalloway

[57] ABSTRACT

A device for cooling molten filaments in a spinning apparatus is improved by using a heating wire type heater in which a pitch of the heating wires surrounding the cooling apparatus is made closer in the upstream (top) region of the extruded filament than in the downstream (bottom) region. Through use of the device the temperature of the cooling air blown from the cooling apparatus for a plurality of molten filaments extruded from a die is controlled so that the cooling is made progressively stronger from the upstream side (i.e., top side) to the downstream side (i.e., bottom side).

1 Claim, 3 Drawing Sheets

DEVICE FOR COOLING MOLTEN FILAMENTS IN SPINNING APPARATUS

This is a division of application Ser. No. 327,085, filed Mar. 22, 1989, now abandoned.

BACKGROUND OF THE INVENTION

1. Field of the Invention

The present invention relates to a method for cooling a plurality of molten filaments comprised of a thermoplastic resin extruded from dies and to an apparatus for carrying out that method.

2. Description of the Related Art

FIG. 3 shows a spinning apparatus for filaments comprised of polyethylene, polypropylene, or other thermoplastic resins. In this apparatus, a plurality of molten filaments 2 extruded from a die 1 are cooled by cooling air blown from a cooling apparatus 3 and then taken up with a draft. The cooling apparatus 3 comprises a chimney 4 connected to a die 1 in a manner so as to surround the molten filaments 2 and a gas temperature adjustment apparatus 5 composed of coolers. The apparatus 5 cools the cooling air to the desired temperature and the cooling air is fed to the chimney 4 by a fan 6 and is blown from the inner peripheral surface thereof through a filter 7. Reference numeral 8 is an exhaust fan.

In the cooling of molten filaments, if the temperature of the cooling air is lowered or the air flow rate is increased so as to rapidly cool the filaments, only the surface of the filaments will be cooled and solidified. If a draft is applied to the filaments in that state, the filaments will melt and break or the elasticity, tensile strength, and other physical properties of the yarn will be lowered. Conversely, if the filaments are gradually cooled, the filaments tend to adhere to each other and, further, the cooling zone must be made longer, and thus the size of the apparatus is necessarily increased.

Even if the spinning speed is increased or changed, if the cooling is carried out without changing the length of the cooling zone, a rapid cooling becomes necessary, and thus the problems discussed above will arise.

SUMMARY OF THE INVENTION

Accordingly, an object of the present invention is to obviate the above-mentioned problems, caused by a too rapid or gradual cooling of the filaments.

Other objects and advantages of the present invention will, be apparent from the following description.

In accordance with the present invention, there is provided a method of cooling molten filaments in a spinning apparatus, where a plurality of molten filaments extruded from a die are cooled by cooling air blown out from a cooling apparatus and are taken up with a draft, wherein the temperature and/or volume of the cooling air blown from the cooling apparatus is controlled so that the cooling is performed stronger, in stages or continuously, from upstream to downstream.

In accordance with the present invention, there is also provided a cooling apparatus in a spinning apparatus where a plurality of molten filaments extruded from a die are cooled by cooling air blown from a cooling apparatus and are taken up with a draft, and wherein (i) a plurality of cooling apparatuses with different temperatures and/or volumes of the cooling air are connected so that the cooling is performed stronger in the downstream stages, (ii) there is provided a heater in the flow path of the cooling air with the pitch of the heating wires is made closer upstream so as to gradually increase the amount of heat generated, or (iii) the flow path of the cooling air is formed so as to be gradually narrower in the upstream direction or is formed so as to gradually increase the pressure loss.

BRIEF DESCRIPTION OF THE DRAWINGS

The present invention will be better understood from the description set forth below with reference to the accompanying drawings, in which.

DESCRIPTION OF THE PREFERRED EMBODIMENTS

According to the present invention, the above-mentioned problems can be solved by controlling the temperature and/or volume of the cooling air so that the cooling is performed stronger, in stages or continuously, from upstream to downstream of the filament flow.

The easiest way to change the cooling in stages and the easiest in terms of control is to divide the cooling zone into several sections, a cooling apparatus is provided for each section, and the cooling by the apparatus is made stronger in the downstream direction.

To change the cooling continuously, it is possible to adopt, for example, a method of arranging a heater in the flow path of the cooling air, and the pitch of the heating wires is made closer in the upstream direction so as to gradually increase the amount of heat generated, whereby the cooling air is warmed by contact with the heater and then blown or a method of forming the flow path of the cooling air is gradually narrowed in the upstream direction or the pressure loss is gradually increased to gradually reduce the amount of air upstream of the filament flow.

Further, when the spinning speed is changed, the degree of strength of the cooling can be changed.

Although the temperature and volume of air for cooling largely depend upon the materials to be extruded, the temperature of the molten filaments, and the extrusion rate, the temperature of the cooling air is preferably −20° C. to 140° C., more preferably 0 to 100° C., and the volume of the cooling air to be blown is preferably 2 to 40 $m^3/kg$, more preferably 5 to 25 $m^3/kg$. The materials to be extruded include, for example, polyethylene, polypropylene and other thermoplastic resins.

The molten filaments extruded from the die are cooled weakly at the upstream portion of the cooling zone and strongly at the downstream portion thereof. When the cooling is weak, the temperature difference of the filament surface and interior is made small and the draft is applied in that state to ensure that, a uniform draft is applied, whereby the elasticity, tensile strength, and other physical properties of the filaments are improved, and melting and breaking occur with difficulty. Further, at the downstream side where the filaments are taken up, a strong cooling is performed for solidification, so adhesion between filaments occurs with difficulty. Thus, it is possible to make the cooling zone shorter than with gradual cooling of the whole.

If the spinning speed is increased, it is possible to avoid rapid cooling by increasing the ratio of the weak cooling in the cooling zone. Note that when the spinning speed is reduced, there is no problem if the ratios of the strength of the cooling are varied.

EMBODIMENTS

Figure 1:
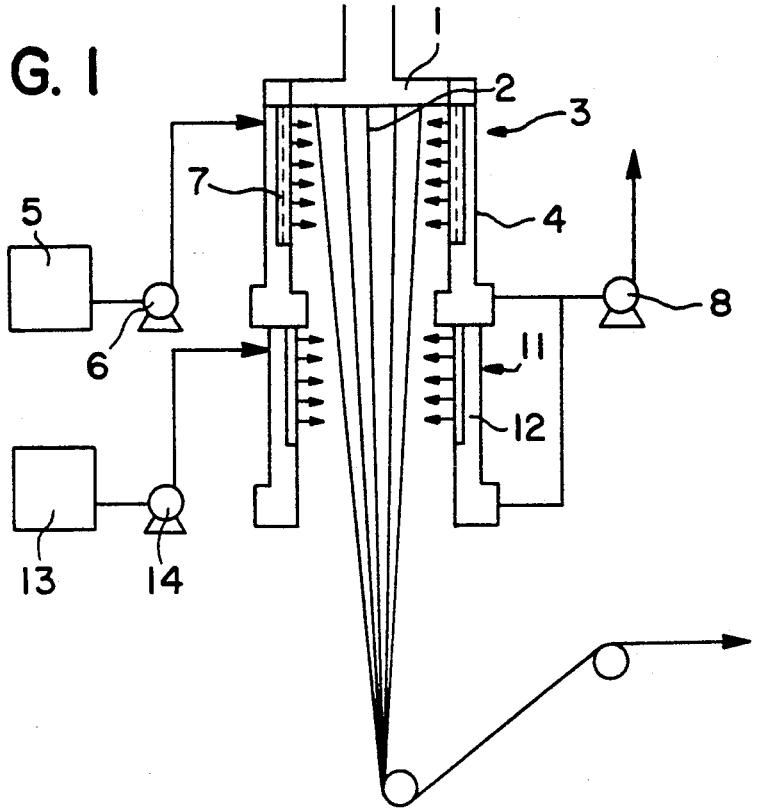
FIG. 1 is a schematic view of a spinning apparatus provided with a cooling apparatus according to a first embodiment of the present invention.
Figure 3:
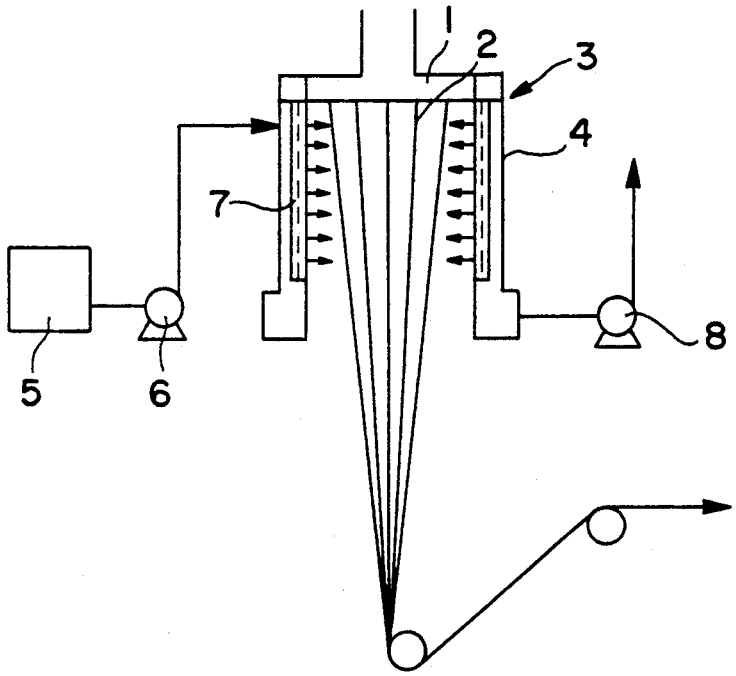
FIG. 3 PRIOR ART
FIG. 3 is a schematic view of a conventional spinning apparatus.

FIG. 1 shows a first embodiment of two-stage cooling apparatus according to the present invention, having the same construction as that of the cooling apparatus 3 provided in the spinning apparatus as shown in FIG. 3, except for the filter at the bottom of the cooling apparatus 3, i.e., is comprised of a chimney 12 and a gas temperature adjustment apparatus 13 comprised of coolers. The said apparatus sends the cooling air, cooled to a desired low temperature by the top stage gas temperature adjustment apparatus 5, to the chimney 12 by the fan 14 and connects this to a cooling apparatus 11 so that it is blown out from the inside peripheral surface. It blows out relatively high temperature cooling air from the top stage and relatively low temperature cooling air from the bottom stage thus slowly cooling the molten filaments 2 at the top stage and rapidly cooling them at the bottom stage.

For example, when polyethylene is used, the preferable cooling conditions are as follows:

Top stage: 30° C. and 8 $m^3$/kg

Bottom stage: 10° C. and 8 $m^3$/kg

In the above-mentioned embodiment, the temperature of the cooling air blown out from the bottom stage is made lower than that at the top stage, but it is also possible to change the air amounts of the fans 6 and 14 so as to increase the amount of air of the bottom stage over the top stage and further possible to change both the temperature and air amount of the top and bottom stages.

A typical example of the cooling condition when polyethylene is used is as follows:

Top stage: 20° C. and 4 $m^3$/kg

Bottom stage: 10° C. and 8 $m^3$/kg.

Figure 2:
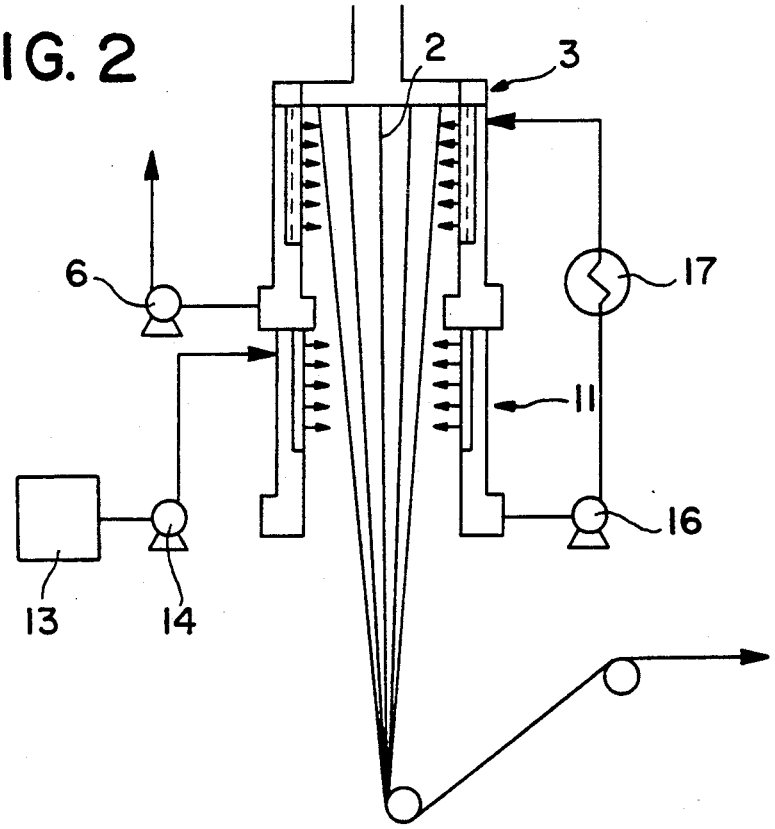
FIG. 2 is a schematic view of a spinning apparatus provided with another cooling apparatus.

The embodiment shown in FIG. 2 is comprised in the same way as the apparatus shown in FIG. 1 outside of the fact that the fan 6 in the apparatus shown in FIG. 1 is made an exhaust fan and the cooling air of the bottom stage is exhausted from the fan 16, heated by the heater 17, then blown out from the top stage. As a result, cooling air of a relatively higher temperature is blown out from the top stage and cooling air of a relatively lower temperature is blown out from the bottom stage.

Figure 4:
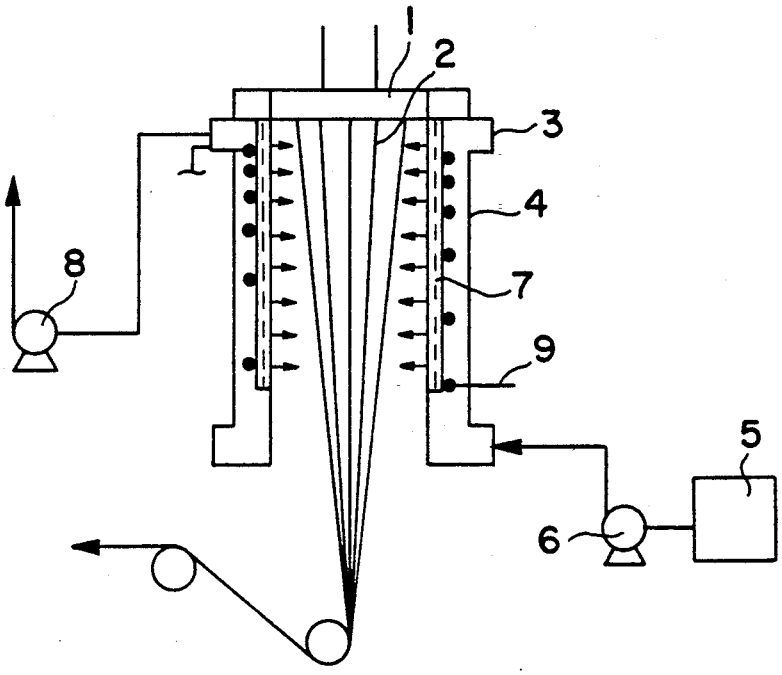
FIG. 4 is a schematic view of a spinning apparatus with a further cooling apparatus.
Figure 5:
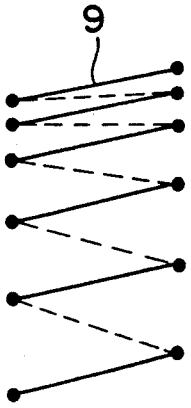
FIG. 5 is a schematic view of a heating coil as utilized in the apparatus of FIG. 4.

The above-mentioned embodiment shows an example where two cooling apparatuses are connected for two-stage cooling, but in another embodiment three or more cooling apparatuses may be connected for multi-stage cooling and in still another embodiment, as shown in FIG. 4, heating wires 9 may be wound around the internal peripheral surface of the chimney 4 and the pitch made gradually closer upstream, as best seen in FIG. 5, so as to heat the cooling air and give it a temperature gradient so that the temperature gradually falls downstream, whereby the cooling can can be made continuously stronger downstream. Further, in another embodiment, the flow path of the cooling air can be formed to be gradually narrower upstream or formed so that the pressure loss gradually increases, thereby gradually decreasing the amount of the cooling air upstream.

As mentioned above, according to the method of this invention, the cooling is made performed weaker at the upstream side and stronger at the downstream side, thereby improving the elasticity, tensile strength, and other physical properties of the filaments without enlarging the apparatus and further making molten breakage difficult and preventing mutual adhesion of filaments.

According to the method of this invention wherein the degree of strength of the cooling is changed by the spinning speed, even if the spinning speed is changed to make it faster, the degree of the cooling at the weaker portion of the cooling zone can be increased so as to avoid rapid cooling or elongation of the cooling zone.

In the cooling apparatus of this invention, a plurality of cooling apparatuses are connected so as to strengthen the cooling in stages downstream.

In the cooling apparatus according to another embodiment of this invention, the temperature of the cooling air can be given a temperature gradient descending in the downstream direction and the cooling can be made continuously stronger downstream.

In the cooling apparatus according to still another embodiment of the invention, the volume of the cooling air can be gradually increased downstream and thus the cooling can be made continuously stronger downstream.

We claim:

1. In a spinning apparatus having a die for extruding a plurality of molten filaments in a predetermined direction, cooling means for the blowing air to cool the molten filaments and take-up means for taking up the cooled filaments with a draft, wherein said cooling means comprises a chimney, extending a predetermined distance in said extrusion direction, connected to said die so as to surround said molten filaments, said chimney having an inner peripheral surface which allows air to pass from an interior portion of said chimney to said filaments, and fan means for supplying cool air to said interior portion of said chimney to be blown through said inner peripheral surface onto said filaments, the improvement comprising a heater in the path of flow of the blowing air, said heater including heating wires wound around said inner peripheral surface of said chimney and arranged such that the pitch of the heating wires is closer in an upstream region of said chimney with respect to the extrusion direction than in a downstream region of said chimney, whereby the temperature of the blowing air is higher near the extrusion die and lower near the take-up means, such that the draft is applied to the filaments in the upstream region having a lower temperature differential between the interior and exterior of the extruded molten filaments.

* * * * *